United States Patent [19]

Jewett

[11] 3,956,779

[45] May 18, 1976

[54] TIPPABLE SUNKEN BAFFLES FOR DIVER PROTECTION IN POOLS

[76] Inventor: Harold A. Jewett, 5451 42nd St., NW., Washington, D.C. 20015

[22] Filed: July 15, 1975

[21] Appl. No.: 596,173

Related U.S. Application Data

[63] Continuation-in-part of Ser. No. 533,256, Dec. 16, 1974.

[52] U.S. Cl. ..... 4/172; 4/172.19; 4/172.21; 272/1 B; 272/56.5 R

[51] Int. Cl.[2] ..... E04H 3/16; E04H 3/18

[58] Field of Search ..... 4/172, 172.19, 172.21; 272/66, 65, 1 B, 1, 56.5 R

[56] References Cited

UNITED STATES PATENTS

| | | | |
|---|---|---|---|
| 1,648,196 | 11/1927 | Rohmer | 272/1 B |
| 2,645,483 | 7/1953 | Smith | 272/66 |
| 2,918,281 | 12/1959 | Towle | 272/66 |
| 2,998,250 | 8/1961 | Wittryp | 272/66 |
| 3,083,965 | 4/1963 | Jewett | 272/66 |
| 3,176,982 | 4/1965 | O'Daniel | 272/65 X |
| 3,271,787 | 9/1966 | Clary | 4/172.21 |
| 3,497,877 | 3/1970 | Lavell | 272/56.5 |
| 3,708,807 | 1/1973 | Chase | 4/172 |
| 3,793,653 | 2/1974 | Brooks | 4/172 |
| 3,804,405 | 4/1974 | Giddings | 272/66 |
| 3,809,392 | 5/1974 | Kral, Jr. | 272/66 |
| 3,856,296 | 12/1974 | Fischer | 272/66 |

*Primary Examiner*—Henry K. Artis

[57] ABSTRACT

Novel baffles are provided for safeguarding divers from severe head, neck or back injuries due to unexpected collisions with bottom walls of pools, and operate on the principle of "rolling with the punches" rather than taking them head-on, with the buoyant force of the layer of pool water immediately underlying the frontward platform-like impact-receiving portion of the baffle serving to cushion the downward or downward-frontward tipping movement which results from collision therewith of the body of a descending diver and aid in returning said platform-like portion to its initial position; whereby difficulties with excessive rebound or whiplash action of the baffle are obviated.

In step-wise series or cascades, two or more may act sequentially and independently, so that rebound force generated by one comes too late to affect the diver, his body meanwhile having passed out of range of such rebound force and into cushioned contact with the next.

Special further arrangements of the new baffles are also disclosed for protecting the heads of slide-divers doing unexpected somersaults, as well as for permitting divers to intentionally convert their divers into partial or full dive rolls to be terminable on cushioned slideways sloping from the water level immediately in front of the slide and in a downwardly-forwardly manner, without incurring risk of paraplegic injury in the process.

9 Claims, 22 Drawing Figures

ORDINARY DIVE ROLL (PRIOR ART)

TIPPABLE SUNKEN BAFFLES FOR DIVER PROTECTION IN POOLS

This application is a continuation-in-part of Ser. No. 533,256 which was filed Dec. 16, 1974 and is intended to be included herein by reference.

Like said parent application, this one relates to safety baffling for placement in swimming pools to protect divers against surprise collisions with walls thereof, particularly bottom walls.

Applicant is unaware of relevant art other than that represented and discussed in the parent case. Also, and unlike it, the present case is limited to baffles having upwardly exposed platform portions which, in position of use, are not only submerged in pool water but also are so constructed and disposed as to tip downwardly in a unitary or tabular manner in response to impact from the body of a descending diver, as well as to concurrently lessen the steepness of his trajectory by increasing its horizontal component; said downward tipping causing egress of circumambient pool water from directly beneath said platform portions, the return movement of the platform portion being caused or aided by reingress of pool water into the space whence said egress occurred.

The principle involved in said egress and ingress was within the contemplation of FIG. 9 of the parent case, as regards the shingle baffles indicated by the arcuate lines thereof and the text relating to shingle baffles in the discussion of FIGS. 5 and 3 of said case. Otherwise, applicant is unaware of any art dealing with the use of pool water to buoyantly support a baffle in its up position, or aid in so doing, or to return a down-tipped baffle to its up position following down-tipping produced as aforesaid.

In brief, the application has as its main object the use of said bouyant force of underlying pool water to egressingly cushion down movement of a safety baffle platform portion such as above described, as well as to produce or aid the return movement of said platform portion to its initial position at a sufficiently slow rate to substantially obviate rebound or whiplash difficulties.

Included within said main object of the invention is the achievement of further and improved solutions to the problem of head, neck and back injuries to slide divers which was particularly dealt with in connection with FIGS. 2 and 3 of the parent case. Particularization of such solutions will be set out below. Additional objects and their achievement will appear as the description of the invention proceeds.

In the drawings, wherein all figures are to be understood as basically diagrammatic or schematic, and all expressions such as horizontal, upward, front, rear, etc., as being relative and approximate unless otherwise evident, to be more particularly described later on:

FIG. 1 is a side elevational diagram, with certain parts broken away and others omitted, of the deep-end portion of a usual form of swimming pool after it has been equipped with novel buoyant baffles of the invention to protect divers descending within the zone generally indicated by the arrows and their lines in the figure; the pool bottom frontward of the slide indicated at the right end of the figure being also equipped with novel safety baffling of the invention as described below;

Figure 1:
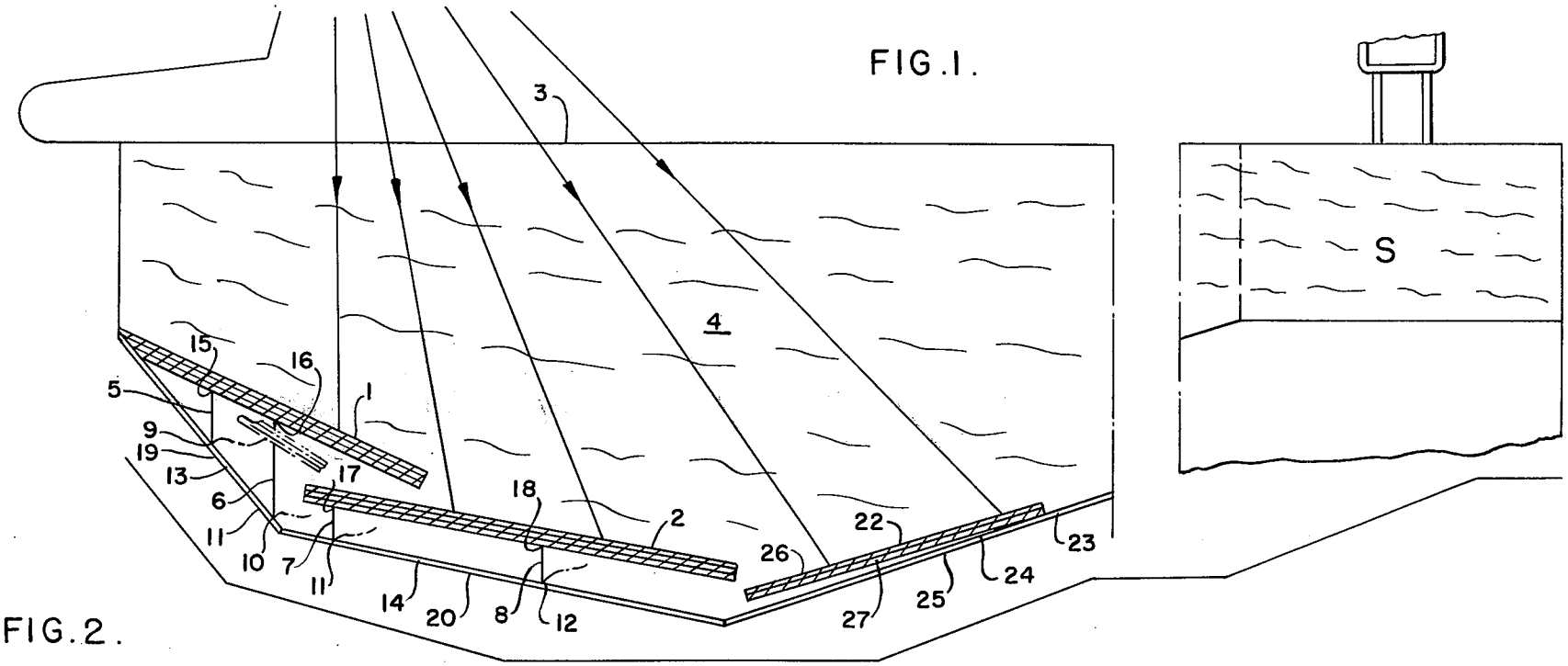
Figure 2:
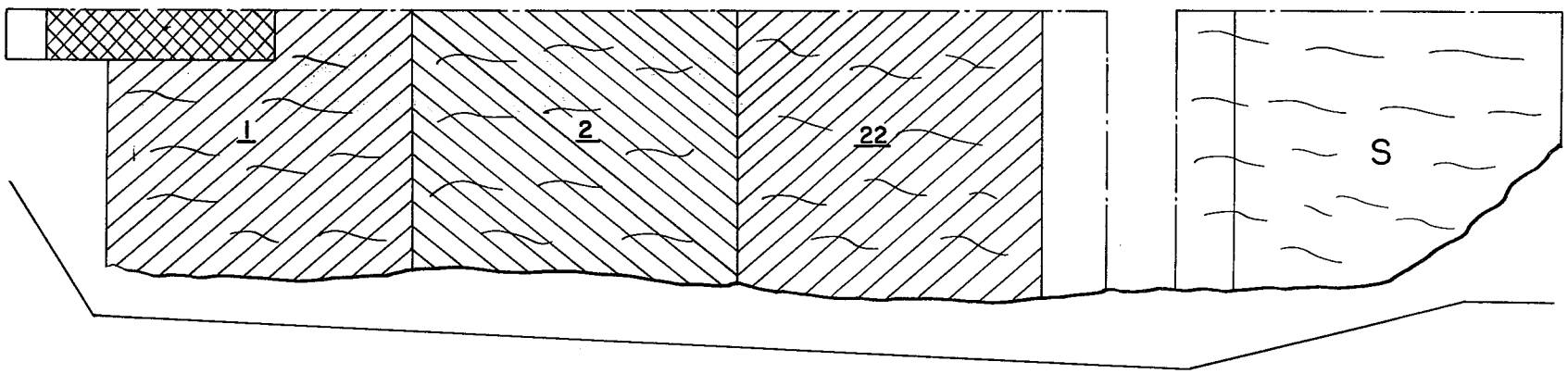
FIG. 2 is a plan view of the structures appearing in FIG. 1, except that the left half of the pool has been omitted and the right half (commencing at the center line, and extending rightwardly therefrom) has been broken away.
Figure 5:
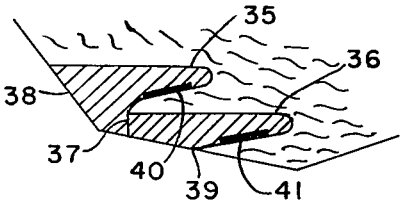
FIG. 5 is a side elevational diagram of a stepwise series of two further baffles (their vertical thickness being purposely exaggerated for illustrative purposes) of the invention in position of use; said baffles differing from those of FIG. 1 in respects to be brought out below.
Figure 7:
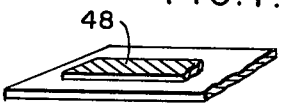
Figure 8:
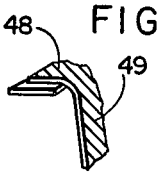
Figure 6:
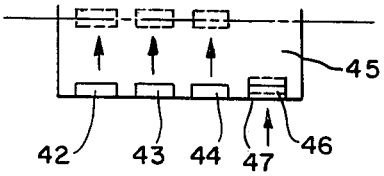
Figure 9:
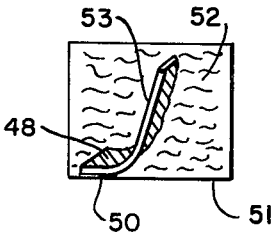
Figure 10:
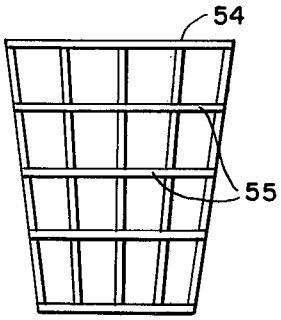
Figure 12:
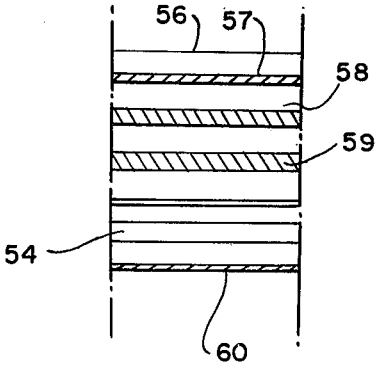
Figure 11:
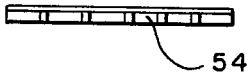
Figure 13:
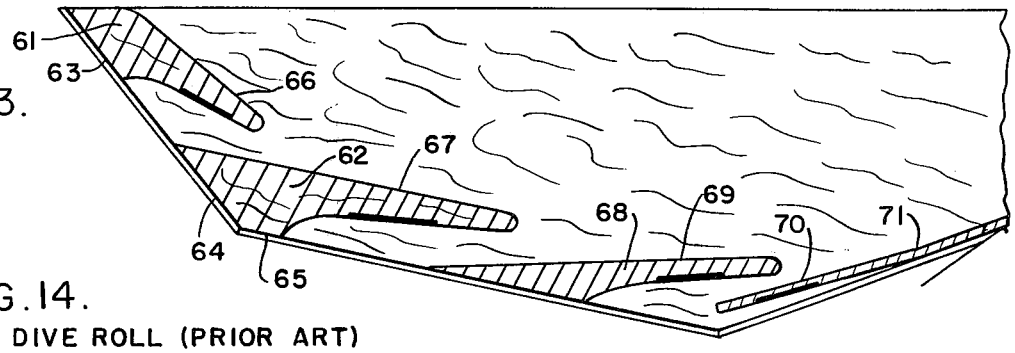
Figure 14:
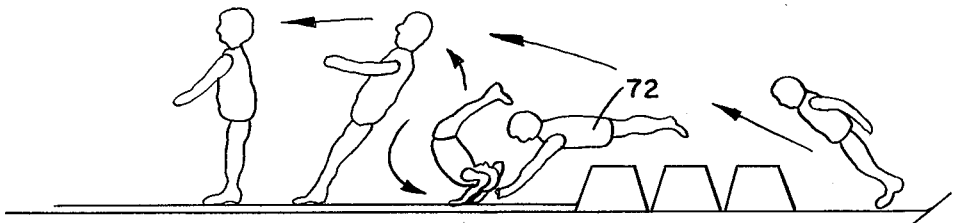
Figure 18:
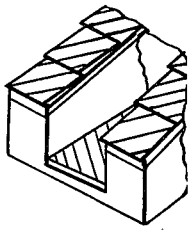
Figure 15:
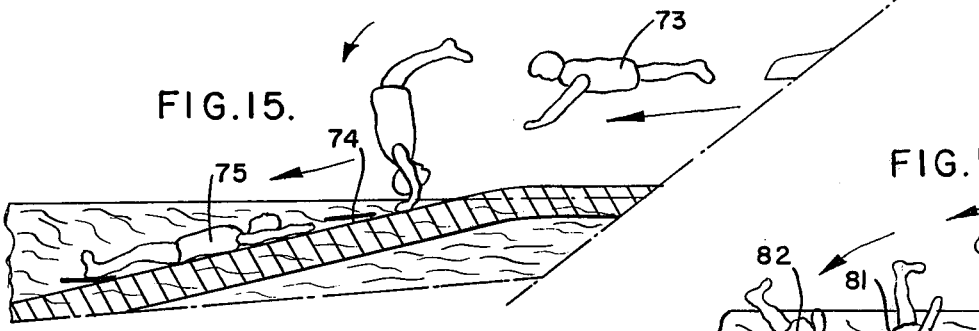
Figure 19:
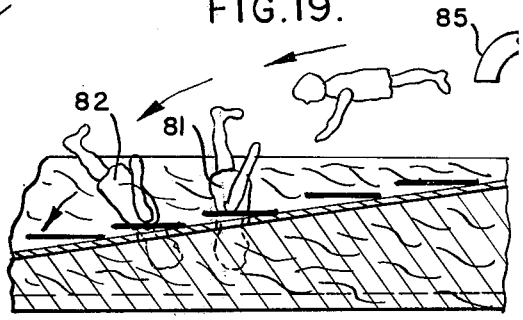
Figure 16:
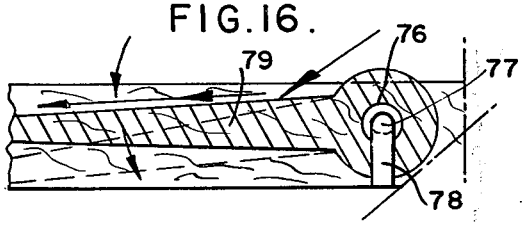
Figure 20:
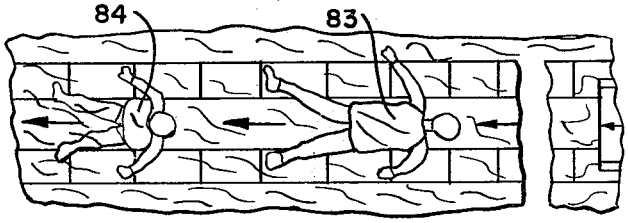
Figure 17:
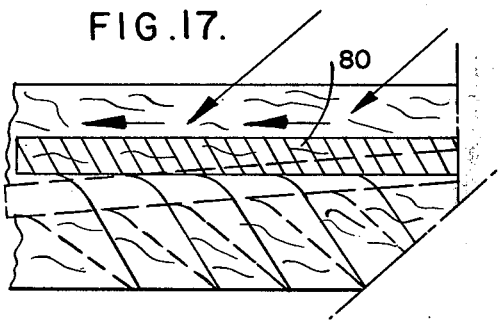
Figure 22:
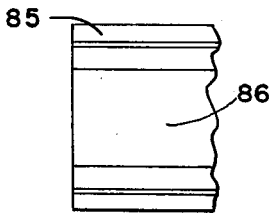
Figure 21:
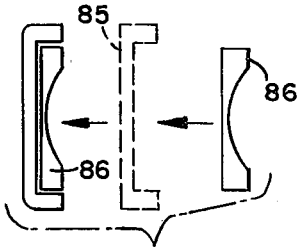

FIG. 6 is an analytical diagram depicting the distinctive rebound-retarding slowness or logyness of the low-density (about 1.5 pounds per cubic foot) polyurethane foam contemplated in FIGS. 1 and 5 ("rebound", as used herein, being synonymous with "whiplash," "backlash," "recoil," etc.) when filled with water which it has automatically soaked or sponged-up; such soaking or sponging-up being made possible by the "open-cell" character of the foam, as distinguished from the water-impervious character of "closed-cell" foams;

FIG. 7 is a fragmentary diagram of a ½ inch-thick strip of said polyurethane foam in its dry state, resting on a flat support;

FIG. 8 is a further fragmentary perspective diagram showing the foam strip of FIG. 7 with one end affixed to said flat support and the other end dangling freely downward in mid-air, thus exemplifying its lack of sufficient rigidity or stiffness to resist even the flexing produced by its own extremely light weight;

FIG. 9 is the same as FIG. 8 except that the foam strip has been immersed in a body of water the buoyant force of which has forced the strip to flex upwardly rather than downwardly;

FIG. 10 is a plan view diagram of stiffener framework contemplated for the rear and middle baffles appearing in the left side of FIG. 1;

FIG. 11 is a rear elevational diagram of the framework appearing in FIG. 10;

FIG. 12 is an exploded cross-sectional detail of said middle baffle of FIG. 1, with laminae of which it is comprised shown in mutually exploded relationships;

FIG. 13 is the same as FIG. 1 except for omission of some of the parts, and substitution of modified forms and arrangement of the baffles of FIG. 5 (and also exaggerated in vertical thickness, as were they) for the first two baffles of FIG. 1;

FIG. 14 is a left side elevational diagram depicting execution of the well-known dive roll (or "forward dive roll") of presumably worldwide prior art, so commonly practiced by school children in their gymnastic classes;

FIG. 15 is a side elevational diagram, partly in section, of a juvenile diver executing the first half of the dive roll depicted in FIG. 14, but using gravitational momentum generated by the slide (indicated at the right end of the figure) rather than momentum produced by the running start implied in FIG. 14; the diver in FIG. 15 being shown as cushionedly "caught" by a baffle of the invention immediately after his entry into the water—much as a baseball is caught by a player's yielding glove—and thus spared a precipitous collision with the subjacent bottom of the pool;

FIG. 16 is a side elevational detail of a baffle such as the middle one of FIG. 1, except that the flexible anchor lines extending downward from the under surface of the baffle have been replaced by pool-bottom based hinge structure;

FIG. 17 is generally similar to said middle baffle of FIG. 1 except that its resiliently yielding support means, instead of being flexible anchor lines or hinge structure such as in FIGS. 1 and 16, respectively, is supplied by a series of frontwardly slanting leaf springs affixed at their lower ends to the pool bottom and at their upper ends to the underside of the baffle;

FIG. 18 is a front perspective detail of the front end of a channel providing for safe passage of the head and neck of a slide-diver who may have unwittingly executed a somersault such as depicted in FIG. 2 of above mentioned parent application Ser. No. 533,256, the baffles-equipped walls defining said channel being so down-pitched and spaced as to be certain to slippingly engage the shoulders of said diver, while yet preserving abundant space for protectively accommodating his head and neck during the instant of their upside-down travel;

FIG. 19 corresponds to FIG. 15 except that whereas the somersault has been unexpectedly produced in the manner illustrated in aforesaid FIG. 2 of parent application Ser. No. 533,256, the diver's head and neck have been safeguarded from injury as depicted in FIG. 18;

FIG. 20 is a plan view of the subject matter of FIG. 19 except that certain portions are broken away, and the diver's posture is shown not only while he is being supported by the baffles on the tops of the side walls of the FIG. 18 channel, but after he has achieved the sitting-up position shown at the left end of FIG. 20;

FIG. 21 is an exploded detail schematically depicting, in front-end view, a novel centering inlay for affixation between the side walls of a conventional poolside slide, to in effect restrict use of the slide to a selected juvenile body-width range, besides introducing a downwardly convex cross-sectional curvature into the upper face of the inlay for insuring precise centering of sliders' trajectories so that they will coincide exactly with the middle of the neck and head-protective channel of FIGS. 18–20; and FIG. 22 is a plan detail of the structures appearing in FIG. 21 following incorporation of said centering inlay into the exit end of the slide in FIGS. 19–20.

Figure 3:
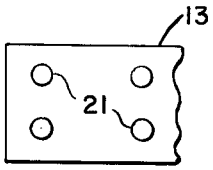
FIG. 3 is a schematic diagram of the leftmost anchor pad of FIG. 1, partly broken away, depicting optional spot-glueing thereof to the rearmost portion of the pool bottom.

Referring to the drawings in detail:

In FIGS. 1–3 platform-shaped baffles 1 and 2 are respectively held down—i.e. prevented from rising to surface 3 of water 4 in the pool (unnumbered) due to buoyance of the water—by flexible non-stretchable anchor lines 5, 6, 7, and 8, attached at their lower ends at loci 9, 10, 11, 12 to portable mat 13 (in the case of lines 5 and 6) and portable mat 14 (in the case of lines 7 and 8). Additionally, said anchor lines 5–8 are attached to the underside of each respective said baffle at loci 15, 16, 17, and 18, thus permitting unitary downward and/or frontward movement of the frontward upper surface of the baffles in response to impacts from descending divers, as well as subsequent return to their initial, at-rest postures via buoyance of the subambient water layers below them.

Optionally, said mats 13 and 14 may simply be rested on the sloping portions 19 and 20 of the subjacent pool bottom; either the abrupt changes (unnumbered) in slope of the pool bottom being relied on to per se confine said mats in place, or spot-glueing (waterproof), as indicated in loci 21 of FIG. 3 be applied, or such other mode of affixation as may be desired.

Said mats 13 and 14 serve not only to fix the locations of the baffles during use and to provide protective cushioning for the pool bottom should a portion of a baffle happen to impinge on it, but also to facilitate packaging of the baffles and their anchor lines for transportion.

Laminations comprised in the baffles will be discussed below.

The dash lines (unnumbered) extending rightwardly from loci 9, 10, 11, and 12 in FIG. 1, as well as the unnumbered fragment of baffle 1 attached to the end of the dash line extending from locus 9, are intended to depict downward-frontward unitary, integral or tabular (like a table-top) movement of the baffles 1 and 2 imparted to them by a diver striking baffle 1 and skidding or ricocheting from there to baffle 2, or baffle 22 as well.

Said baffle 22 is anchored directly (e.g. by glueing) to mat 23 as at locus 24 on sloping portion 25 of the pool bottom, the at-rest posture of baffle 22 having been pre-determined by suitable weighting or counterpoising as discussed below.

The particular structure of baffle 22 includes an upwardly-exposed surface liner 26 which is more dense than the flexible polyurethane foam or other light weight cellular-solid chosen for cushioning lamina 27 subjacent to it.

Further laminae which advantageously may be incorporated into baffle 22 will be referred to below.

The letter S appearing at the right side of each of FIGS. 1 and 2 represents novel baffle structures and arrangements useful in connection with slide dives, also to be discussed below.

Figure 4:
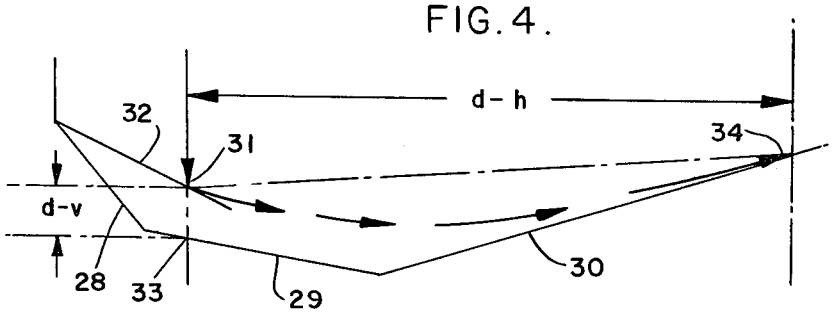
FIG. 4 is an analytical diagram to be referred to later in discussing the basic safety aspects of the invention.

In FIG. 4 lines 28, 29 and 30 correspond, respectively, to sloping portions 19, 20 and 25 of FIG. 1; and the tip of the arrow 31 represents an illustrative impact with the skid-surface (unnumbered) of baffle 32 corresponding to baffle 1 of FIG. 1. In addition, line d-v represents the vertical distance between said tip of arrow 31 and the point 33 on said sloping portion 29 directly below it; while line d-h represents the horizontal distance from there to the imaginary vertical plane which includes the tip of arrow 34; said arrow representing an illustrative terminal point of the diver's trajectory following such impact. Not only is line d-h about twelve times as long as line d-v, it also represents the end point of a diver's coasting through a relatively long horizontal cushion of water, in contrast to a calamitously violent collision with the bottom of the pool at point 33 immediately below said point of impact at the tip of arrow 31.

In FIG. 5 baffles 35 and 36 correspond to baffles 1 and 2 of FIG. 1, the frontward portions of all four of which baffles are buoyantly supported by subambient layers of pool water which are forced to egress when said frontward portions move downwardly under impacts of descending divers. In this respect, as well as others presently to be mentioned, all four of said baffles differ substantially from the baffle structure represented in FIG. 10 of parent application Ser. No. 533,256. Thus, instant baffles 35 and 36, as well as baffles 1 and 2, are respectively in cascade or stepwise relationship, so that a diver impinging on the upper one of either pair is glancingly thrown or tumbled to the lower one through space which initially separated the front end of the upper baffle from the upper surface of the lower baffle. Additionally, baffle 36 in FIG. 5 is separated from baffle 35 therein by vertical slit 37 extending transversely of the baffles. This prevents rebound of baffle 35 from affecting the functioning of baffle 36, so that the cushioning of the latter is not complicated by rebound stresses exerted by the former.

In a sense, without slit 37 the union between the foam anchor portions 38 and 39 of the two baffles would represent a sort of "muscle-bound" condition, which is alleviated by the existence of said slit 37; and the same principle is at work in the case of baffles 1 and 2 of FIG. 1, in that the buoyant recovery of the initial at-rest position by baffle 1, due to buoyant force of the water layer underlying it and baffle 2, is not physically connected to any of the baffle 2 structure. This freedom from muscle-bound behavior was not shown in said FIG. 10 of the parent application, although its principle was involved in the behavior of the "shingles" 16 of FIGS. 5, 3 and 9 thereof, as discussed in the paragraph bridging its pages 10 and 11.

The sheet-lead strips 40 and 41 in FIG. 5 serve to counteract the buoyance of the subjacent layer of water to a pre-calculated degree, as is manifested in the downwardly yieldable posture of each of the baffles 35 and 36; this being analogous to the above-discussed pre-determined posturing of baffles 1 and 2 of FIG. 1, which was accomplished by pre-calculated dimensioning of the anchor lines 5–8, rather than by weighting with lead strips 40, 41 or the like, as in FIG. 5.

A major advantage of the cascading of baffles 38 and 39 of FIG. 5 as well as baffles 1 and 2 of FIG. 1 is that when the diver leaves the upper baffle his next contact is with a totally fresh one, none of whose cushioning action has yet been spent; and the same advantage can be repeated with each further baffle which may be incorporated into the cascade.

In FIG. 6 oblong samples 42, 43 and 44 of, respectively, pine, balsa wood of density about ten pounds per cubic foot, and polyurethane foam having a bulk density of about 1.5 pounds per cubic foot (marketed as a product of Firestone Foam Products Co.), when pressed against the bottom of acquarium 45 and then suddenly released, rise to the water surface in a small fraction of a second. But sample 46, consisting of the same polyurethane foam as 44 but thoroughly squeezed against the bottom 47 of the acquarium 45 just before its release, appears to take about four times as long to surface as did each of the samples 42, 43 and 44. This illustrates the usefulness of the open-cell structure of said foam, in slowing down the rebound effect following release of compressive stress to which it may have been subjected, and thus is a factor for consideration in selecting materials and proportions for the baffles of the invention.

In FIGS. 7–9 a strip 48 of said foam in its dry state is shown as pulled almost vertically downward by gravity when deprived of frontward support, as illustrated at 49 of FIG. 8. This, as already pointed out above, shows the extreme flexibility of said foam when dry. But when the same strip is pressed against the bottom of the acquarium 51 as schematically depicted in FIG. 9, the same flexibility permits the circumambient water 52 to buoy the strip into the nearly vertical posture indicated at 53. This accounts for the points brought out above in connection with the sheet-lead strips 40 and 41 of FIG. 5, besides elucidating the functioning of anchor lines 5–8 in FIG. 1 above and evidencing the desirability of providing the baffles of the invention with a density not far below that of the pool water, in order to moderate the stresses exerted by the baffles on their anchor lines or other anchorage structures, as well as by the latter on mats such as 13 and 14 of FIG. 1, or the pool bottom directly as in the case of the glue-anchoring contemplated for the baffles of FIG. 5. Further in the same connection, it may be noted that the use of extremely lightweight foam or other cushioning medium in water-impervious condition necessitates more vertical dimension (other things being equal) for the other portions of the baffle, to achieve a given approximation of the density of the water.

The last observation has to do only, of course, with practicing embodiments of the invention wherein the baffles are buoyant since, as will be pointed out below and contemplated in some of the claims, the invention can readily be practiced with baffles having densities or specific gravities even higher than that of the pool water.

In FIGS. 10–11 stiffener frame 54 serves to ensure the tabular or platform-like behavior of baffles 1 and 2 of FIG. 1 or any other baffles of the invention during actual use, and may advantageously be formed, e.g., from suitably dimensioned square tubing of hot-rolled steel or wrought iron, united transversely by relatively thin metal strips 55 as by welding, glueing or taping.

Referring to FIG. 12 in particular, the topmost lamina 56 consists of an upwardly exposed skid or ricochet surface of highly slippery (at least when wet) epoxy-type fiberglass composition or the like and about 1/32 inch thick. The next lamina 57 therebelow consists of lightweight polyurethane foam such as mentioned above, but alternatively may be selected from any of a wide variety of lightweight flexible cellular solids, so long as they will function as a suitably yieldable cushioning material, among which may be mentioned flexible foams of nylon, polyethylene, polystyrene, polyvinyl chloride, or even pure cellulose such as is marketed for use as household sponges, and foams of either the open-cell or closed-cell varieties may be selected, as desired, although their behavior will differ as illustrated, e.g., in FIG. 6.

Said lamina 57 is intended to provide relatively painless contact when a descending diver strikes the upper lamina 56, but without destroying its platform-like characteristic or its unitary tabular movement during the tipping produced by the impact. This is because of the coaction between said laminae 57 and 56 and the other laminae indicated in FIG. 12, particularly said stiffener frame 54.

Next below cushioning lamina 57 is a lamina 58 of relatively rigid Styrofoam having a thickness of about one-half inch and a bulk density of about one to three pounds per cubic foot; while next below that lamina is a further cushioning lamina 59 of flexible cellular solid such as aforesaid; which, it may be added, might even be comprised of cushioning material such as kapok, feathers or shredded lightweight materials of other varieties, provided of course they are insulated from the water in the pool in case they would affect it, or vice versa.

The bottom lamina 60 in FIG. 12 is of rubber floor matting such as commonly used in automobiles; its purpose being to cushion any impact between the baffle and a bottom wall of the pool, particulary when no structure such as mats 13 and 14 of FIG. 1 is present.

The number, nature and thicknesses of the aforesaid laminae of FIG. 12 are of course a matter of choice, since the platform character of the exposed upper surface, and its tabular type of tipping in response to diver impact (to thereby cushion the force of that impact while simultaneously imparting a more nearly horizontal direction to the diver's underwater trajectory) are the basically essential factors, with pain-moderating comfort to the diver being relatively just a luxury, i.e., as compared with the basic objective of saving him from fatal, near-fatal or even worse-than-fatal neck, head or back injuries that would have resulted had the baffle not been present. And such basic objective can, it is believed, be achieved—approximately at least—with much less overall baffle thickness than indicated in FIG. 12, and possibly with merely a thin surface liner, a single lamina of flexible cushioning material adjacent thereto, and a stiffener lamina comprised only of Styrofoam. This does not mean that such a baffle might not crack or fracture, internally at least, under violent diver impact, since such a fracture could well occur and yet the baffle, in the process of being thus fractured, fulfill its basic purpose of major-fatality prevention nevertheless.

In FIG. 13 baffle 61 is analogous to baffle 38 of FIG. 5 described above, and baffle 62 to baffle 39 thereof; the main differences being that baffles 38 and 39 were contiguous at the locus of slit 37 in FIG. 5, whereas the glue anchorage 63 of baffle 61, and 64 plus 65 of baffle 62, are disparate, and that whereas the platform portions 35 and 36 in FIG. 5 are shown as horizontal, their analogs 66 and 67 in FIG. 13 slope downwardly-frontwardly. Yet in FIG. 13, the third baffle 68 has a substantially horizontal platform portion 69, and the platform portion 70 of its fourth baffle in fact slopes upwardly.

In the case of all four of said baffles of FIG. 13, precalculated weighting is applied as schematically indicated by the unnumbered thin strips of sheet lead appearing on the underside of the frontward portions of each of the baffles; said strips functioning the same as strips 40 and 41 of FIG. 5 already discussed. The precise dimensions of the weighting strips may be readily arrived at by simple experimentation, e.g., by first gluing the foam body of a particular baffle into position of use, filling the pool with water, and countering the inevitable upward buoying exemplified in FIG. 9 as discussed above, by sufficient weighting to effect the desired degree of downward (or upward) slope for the particular baffle. If lead sheeting be employed for said purpose (it will be referred to hereinafter as counterpoising), it may be affixed in position on the baffle by pressure-sensitive waterproof gluing and/or pressure-sensitive waterproof taping, as e.g., to the bottom and sides or top edges, as well as top side surfaces of the baffle—or by any other desired means, including mechanical only.

FIG. 14 needs no description other than already set out hereinabove, unless to explain that its inclusion seems essential as background for both FIG. 15, on the one hand, and FIGS. 18–22, on the other.

In the prior art dive roll illustrated in FIG. 14, the gymnast (unnumbered) executes a complete roll, and he does it in the absence of any water at all. But in the process his body assumes a horizontal posture, as at 72, which corresponds precisely to the horizontal posture of the diver (unnumbered) immediately following his exit from slide lip 1 of FIG. 2 of parent application Ser. No. 533,256 aforesaid; which posture is identical, as well, with that of the diver 73 in FIG. 15. And the purpose of the frontwardly-downwardly sloping submerged cushion slide 74 of said FIG. 15 is to permit said diver 73 to purposely execute the first half of the familiar dive roll of FIG. 14 (provided he has already mastered the technique for doing it), thereby permitting him to safely enter the water in the novel reclining posture 75 shown in the figure, without any possibility of his suffering the neck injury discussed in the descriptive text of aforesaid FIG. 2 of the parent application.

The operation of the hinged baffle of FIG. 16 of the present application needs no numeralization unless in mentioning that the hinge action is achieved by rotative motion of horizontal cylindrical recess 76 about horizontal pivot pipe 77 supported at its ends by upright portions 78 integral therewith. While downward tipping of the baffle 79 of FIG. 16 is reversed by buoyant force of the subambient water layer, following diver impact, it is manifest that if the baffle has a greater specific gravity than the water, any of a wide variety of mechanical spring mechanisms can be supplied to supplement said buoyant force in returning the baffle to its initial position.

An illustrative form of such spring mechanism is shown in FIG. 17 as supplied by a series of frontwardly slanting leaf springs (unnumbered) which in their solid-line position maintain the baffle 80 in its up position, and in their dash-line position its depressed position.

No description of FIGS. 18–22 appears requisite other than already presented hereinabove, unless to mention that FIGS. 19-20 combinedly show the successive postures of the diver's body assumed at 81, 82, 83 and 84, and that with mechanically precise aiming provided by the exit end of slide 85—at least when it is fitted with inlay 86 adapting it to the purpose pointed out in the general description of FIGS. 18–22 hereinabove, any juvenile diver having a hip-width approximating the width of said inlay will be certain to be automatically safeguarded from head, neck or back injury in executing the dive depicted in FIG. 19.

The above remarks on this score are premised on observations of head widths of many persons, especially juveniles, together with their shoulder widths; the result of which observations has appeared to be that the widths of juveniles' heads are seldom more than about 6 inches, whereas the breadth of their shoulders (tip-to-tip) is seldom less than about 14 inches, so that width of the head channel (unnumbered) in FIGS. 18 and 20 could readily be small enough to ensure their cushioned blocking of downward travel of such a diver's shoulders as depicted by 81 in FIG. 19 and yet, if made e.g. at least 9 or even 10 or more inches apart, to be sure to allow the diver's head to enter the safety space between, as depicted in FIGS. 19 and 20.

It may be further remarked, in connection with FIGS. 18–20, that not only are the channel walls comprised of cushioned upper portions, but they are also provided with shingle baffles (unnumbered) embodying the basic principle discussed in connection with the shingle-type baffles 16 of FIGS. 5, 3 and 9 of parent application Ser. No. 533,256 referred to hereinabove. Also, the platform portion of each shingle appearing in FIGS. 18–20 is buoyantly supported by subambient layers of pool water beneath, as best seen in FIG. 19.

The wide range of choices of commercially available materials useful in the practice of the invention may be indicated as follows:

For waterproof glueing or taping of polyurethane or similar lightweight flexible foams to many other kinds of substances: "Camie" "Pressure Sensitive Spray Adhesive," Camie Company, Inc., St. Louis, Mo., 63126.

For water-tight preservation of baffle frame structure or components thereof: "Apexior 3," Dampney Co., Everett, Massachusetts.

For "absolute water-tightness" of flexible vinyl sheeting, as advertised by H. Heldor Associates, Inc., on Page 153 of the 1972 Data and Reference Annual (39th Edition) published by Swimming Pool Weekly and Swimming Pool Age: "Krete" (trademark for Flexible Vinyl Film & Sheeting, Union Carbide Corp. Chemicals and Plastics, N.Y., N.Y.).

For rubber coatings for preservation of acid-immersed metal, etc., the product described in U.S. Pat. No. Re. 19155 (of 1813440); and cf. U.S. Pat. No. 2,500,120 and 3702784 as well, for pertinent pressure treated wood.

Also, a great many pertinent topics are indexed in the 1975 Edition of the aforesaid Data and Reference Annual, with many dozens of manufacturers respectively listed under them, as e.g. those on Page 316, Col. 2, under "Liners, Film and Sheet For," and "Liners, Vinyl"; also, on Page 319, Col. 1, under "Paint"; and on Page 324, Col. 2, under "Pools, Fiberglass."

In regard to materials for the laminae of the baffles, particularly framework therein, it will be understood that to facilitate egress and ingress of water, particularly retardation of rebound incident to frictional resistance to water flow, e.g. at interfaces between baffle surfaces and pool water, holes or other apertures may of course be provided as desired.

Referring again to the subject matter of FIG. 15 and 18–22, it may be observed that the structures thereof would not entail need for deepening the bottoms of shallow ends of pools where slides have already been installed. In other words, no drowning hazard which such deepening might generate would need to be involved.

In respect to the basic glance-contact principle of the safety baffles of not only the instant application but its parent case, it is pertinent to stress that they function on the principle of "rolling with the punches," rather than taking them head-on.

What is claimed is:

1. In combination:

a swimming pool having a diving zone comprising frontwardly-downwardly sloping bottom walls, and containing water, a safety baffle submerged in said water, anchorage means affixed to said baffle for mooring it to a said bottom wall, said baffle comprising a buoyant forward portion containing a cushioning material underlying a platform-like upper surface which is disposed for being contacted by the body of a descending diver, said forward portion being disposed to undergo tabular downward tipping consequent on its said upper surface being thus contacted, and a layer of subambient pool water underlying said forward portion, whereby such tipping causes egress of water from said layer, and return movement of said forward portion is aided by re-ingress of pool water into space initially occupied by such water, said egress serving to cushion said contacting, and said re-ingress serving to moderate ensuring rebound action of such forward portion.

2. The combination of claim 1 which comprises a plurality of said baffles submerged in said water, said plurality constituting a cascade, with said upper surface of one of said plurality being more frontward and lower than said upper surface of another of said plurality, said upper surfaces being mutually disparate.

3. A safety baffle for submerged use in a swimming pool, said baffle comprising a rearward portion equipped with means providing anchorage therefor during such use.

said baffle also comprising a buoyant forward portion resting on a subambient layer of pool water beneath it.

said forward portion having an upwardly-exposed platform-like top surface for intercepting the body of a diver descending toward it, said forward portion comprising a lamina of polymeric foam having a bulk density of about 0.5 to 30 pounds per cubic foot, and said forward portion also comprising a frame in juxtaposition to said lamina and serving as a stiffener for said forward portion during use.

4. The safety baffle of claim 3 which is supported by the top of a frontwardly sloping wall of a safety channel disposed in position to protectively receive the head of a somersaulting slide-diver descending toward said channel.

5. The safety baffle of claim 3 which is provided with restraining means attached to said forward portion, for limiting upward movement thereof in response to buoyant force of subambient pool water underlying it.

6. The safety baffle of claim 5 wherein said restraining means comprises weighting material having a specific gravity greater than that of water.

7. The safety baffle of claim 5 wherein said restraining means comprises a flexible cable containing a central core of metal, plus means for affixing said cable to a bottom wall of a swimming pool, said core serving to prevent stretching of said cable during use.

8. In combination:

a swimming pool bounded by a deck, a diving slide mounted on said deck and having an exit lip ovelying water in said pool, a frontwardly-downwardly sloping cushion-topped submerged slide in water of said pool, said last-mentioned slide being directly in line with said exit lip and disposed frontwardly thereof in position to support a diver immediately following his projection from said lip, and to permit his said body to slide downwardly on said submerged slide.

9. A safety baffle for submerged use in swimming pools, said safety baffle comprising a buoyant frontward portion having a platform-like upper surface for receiving the impact of a diver descending upon it, said baffle also having a rearward anchorage portion for affixing it to a downward-sloping bottom wall of a swimming pool, the outline of said baffle as viewed in side elevation comprising a frontwardly-downwardly facing re-entrancy, said re-entrancy being filled with pool water in position to egress under pressure exerted by downward tipping of said upper surface, thereby cushioning said impact of said descending diver.

* * * * *

UNITED STATES PATENT OFFICE

CERTIFICATE OF CORRECTION

PATENT NO. : 3,956,779

DATED : May 18, 1976

INVENTOR(S) : Harold A. Jewett

It is certified that error appears in the above-identified patent and that said Letters Patent are hereby corrected as shown below:

Column 9, line 67, "ensuring" should be: --ensuing--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*